US006815127B2

(12) United States Patent
Kellogg et al.

(10) Patent No.: US 6,815,127 B2
(45) Date of Patent: Nov. 9, 2004

(54) METHOD OF ELECTRONIC PROCESSING OF IMAGEWISE EXPOSED PHOTOCONDUCTIVE MATERIAL IMAGING ELEMENT

(75) Inventors: Lillian M. Kellogg, Webster, NY (US); Joe E. Maskasky, Rochester, NY (US); Dale E. Hamilton, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 180 days.

(21) Appl. No.: 10/295,740

(22) Filed: Nov. 15, 2002

(65) Prior Publication Data

US 2004/0095616 A1 May 20, 2004

(51) Int. Cl.[7] ..... G03C 1/025; G03C 1/035; G03C 5/02; G03C 5/00; G03C 17/00

(52) U.S. Cl. ..... 430/21; 430/48; 430/95; 430/97; 430/367; 430/567; 430/598; 430/605; 358/477; 358/480

(58) Field of Search ..... 430/21, 95, 97, 430/48, 367, 567, 598, 605; 358/477, 480

(56) References Cited

U.S. PATENT DOCUMENTS

| | | | |
|---|---|---|---|
| 4,444,865 | A | 4/1984 | Silverman et al. |
| 4,788,131 | A | 11/1988 | Kellogg et al. |
| 4,933,272 | A | 6/1990 | McDugle et al. |
| 5,360,712 | A | 11/1994 | Olm et al. |
| 6,162,599 | A | 12/2000 | Vandenbroucke et al. |
| 6,284,450 | B1 | 9/2001 | Vandenbroucke et al. |
| 6,624,913 | B1 | 9/2003 | Kellogg |

FOREIGN PATENT DOCUMENTS

| | | |
|---|---|---|
| EP | 1 139 168 | 10/2001 |

OTHER PUBLICATIONS

Copending, commonly assigned, US Ser. No. 10/295,510; filed Nov. 15, 2002; titled "Photoconductive Material Imaging Element"; of Lillian M. Kellogg et al.

*Primary Examiner*—Richard L. Schilling
(74) *Attorney, Agent, or Firm*—Andrew J. Anderson

(57) ABSTRACT

A method of electronic processing of an imagewise exposed dispersed particle photoconductive material imaging element employing pulsed radiation and radio frequency photoconductivity apparatus having a sample capacitor with a gap is described, comprising the steps of: a) placing the imagewise exposed photoconductive material imaging element in an electromagnetic field adjacent the sample capacitor; b) scanning the element through the gap in the sample capacitor with a pulsed, focused beam of radiation; c) directly measuring the photoelectron response of the element and recording the resulting signals from the radio frequency photoconductivity apparatus; and d) advancing the element past the capacitor and repeating steps b) and c); wherein the photoconductive material imaging element comprises photoconductive particles which contain deep electron trapping agents which in an unfilled state effectively decrease the photoconductivity of the photoconductor particles, and wherein imagewise exposure of the photoconductive particles of the imaging element fill deep electron traps and increase the photoconductivity of exposed particles relative to unexposed particles, such that increased imagewise exposure in the photoconductive material results in an increased photoconductivity signal in step c).

18 Claims, 6 Drawing Sheets

METHOD OF ELECTRONIC PROCESSING OF IMAGEWISE EXPOSED PHOTOCONDUCTIVE MATERIAL IMAGING ELEMENT

CROSS REFERENCE TO RELATED APPLICATIONS

Reference is made to copending, commonly assigned, concurrently filed U.S. Ser. No. 10/295,510, the disclosure of which is incorporated by reference herein in its entirety, which is directed towards silver halide imaging elements which may be useful in the method of the present invention.

FIELD OF THE INVENTION

The present invention relates to electronic processing of imagewise exposed dispersed particle photoconductive material. In particular, this invention relates to the use of a radio frequency photoconductivity measurement to scan an imaging element comprising photoconductor particles which have deep electron trapping centers to detect the number of deep electron traps that have been filled as a result of an imagewise exposure.

BACKGROUND OF THE INVENTION

In conventional silver halide photographic imaging elements, imagewise exposure results in the formation of a "latent image" in exposed silver halide grains, which is subsequently amplified through a photographic development process. The latent image in silver halide crystals is formed through the excitation of free charge carriers by absorbed photons and their subsequent trapping and reaction with interstitial silver ions within the silver halide grain structure to form latent image $Ag_n^0$ centers. Carriers which are thought to play an important role in the formation of latent image centers in silver halide grains are believed to be electrons, holes, and interstitial silver ions. Chemical sensitization of the silver halide grains is typically employed to enable efficient formation of stable latent image centers in the grains upon imagewise exposure. Conventional photographic chemical processing develops silver halide grains having formed latent image centers into silver metal. While the use of silver halide photographic systems employing photographic chemical processing has been widely accepted, in some situations it would be desirable to be able to obtain image data directly from the imagewise exposed material without the need for chemical processing.

Silver halide emulsion grains employed in conventional photographic systems are photoconductors, i.e. when they are exposed, either in the silver halide intrinsic absorption region or in a sensitizing dye absorption region, electrons are excited into the conduction band and these electrons are free to move through the silver halide grain. If these grains are placed in an electromagnetic field and then exposed, this photoconductivity can be detected by measuring the change in the field. The mobility of electrons is far greater than that of holes or interstitial silver ions so that conductivity attributed to photoelectrons is expected to be detectable by measurement of photoconductivity of silver halide grains through use of microwave radiation. Such a measurement has been reported using low temperatures, L. M. Kellogg et al., Photogr. Sci. Eng. Vol. 16, 115 (1972). Experiments designed to detect latent image formation in silver halide using microwave photoconductivity are given by A. Hasegawa et al., Journal of Imaging Science, Vol. 30, pp. 13–15 (1986). The technique, which is operated at room temperature, is recognized as potentially useful in detection of latent images without the need for conventional chemical development solution processing. However, the use of microwave frequencies to detect latent image in exposed silver halide photographic materials has shown that such photoconductivity is not sufficiently sensitive to detect low exposure levels.

U.S. Pat. No. 4,788,131 discloses a method for electronically processing exposed photographic materials with an improved level of sensitivity for detection and measurement of latent images contained therein. The method includes the steps of placing the element in an electromagnetic field and cooling the element to a temperature between about 4 to about 270K to prevent further image formation; subjecting the element to a uniform exposure of relatively short wavelength radiation; exposing the element to pulsed, high intensity, relatively longer wavelength radiation to excite electrons out of image centers; and measuring any resulting signal with radio frequency photoconductivity apparatus. Shortcomings of this approach, however, are that it needs to be performed at low temperatures, and there is no easy technique disclosed for making a two dimensional scan of the element.

EP 1 139 168 A2 discloses an improved technique for detection and measurement of latent images in silver halide photographic materials by providing a method of electronic processing of a latent image from a photographic element, the method employing pulsed radiation and radio frequency photoconductivity apparatus having a sample capacitor with a gap, that includes the steps of: placing the element in an electromagnetic field adjacent the sample capacitor; providing an advance mechanism for advancing the photographic element past the capacitor; scanning the element through the gap in the sample capacitor with a pulsed, focused beam of radiation; directly measuring the photoelectron response of the element and recording the resulting signals from the radio frequency photoconductivity apparatus; and advancing the element and repeating the exposing and measuring steps to provide a two dimensional readout of the latent image on the photographic element at ambient or lower temperatures. This technique of directly measuring the photoelectron response of the imagewise exposed photographic element to detect the level of exposure the silver halide grains have received is based on the understanding that latent image $Ag_n^0$ centers which are formed upon imagewise exposure (when mobile interstitial silver ions in the silver halide grain react with the photoelectrons generated during the exposure) act as electron traps which decrease photoconductivity of exposed silver halide grains. Photoconductivity measured in such process employing photographic elements optimized for formation of $Ag_n^0$ latent images thus decreases as the imagewise exposure level the grain has received increases. While the described system is improved relative to the prior art in that there is no need for a uniform exposure of relatively short wavelength radiation (and the associated low temperature cooling step to prevent further image formation) prior to measuring the photoelectron response as well as in providing an easy technique for making a two dimensional scan of the element, photoconductivity measurements obtained by the described process may not be as sensitive as desired in detecting low exposure levels, i.e., giving low photographic speed. Accordingly, it would be desirable to provide a process for directly measuring the photoelectron response of an imagewise exposed element with improved sensitivity.

SUMMARY OF THE INVENTION

In accordance with a first embodiment of the invention, a method of electronic processing of an imagewise exposed photoconductive material imaging element employing pulsed radiation and radio frequency photoconductivity apparatus having a sample capacitor with a gap is described, comprising the steps of:

a) placing the imagewise exposed photoconductive material imaging element in an electromagnetic field adjacent the sample capacitor;

b) scanning the element through the gap in the sample capacitor with a pulsed, focused beam of radiation;

c) directly measuring the photoelectron response of the element and recording the resulting signals from the radio frequency photoconductivity apparatus; and d) advancing the element past the capacitor and repeating steps b) and c); wherein the photoconductive material imaging element comprises photoconductive particles which contain deep electron trapping agents which in an unfilled state effectively decrease the photoconductivity of the photoconductor particles, and wherein imagewise exposure of the photoconductive particles of the imaging element fill deep electron traps and increase the photoconductivity of exposed particles relative to unexposed particles, such that increased imagewise exposure in the photoconductive material results in an increased photoconductivity signal in step c).

In accordance with a preferred embodiment of the invention, the photoconductive material imaging element employed in the method of the invention includes a planar support and a silver halide emulsion comprising silver halide grains which have not been chemically sensitized and which are doped with a deep electron trapping agent dopant. In a more preferred embodiment the non-chemically sensitized, deep electron trapping agent doped silver halide grains comprise tabular grains, preferably with an average grain size equivalent circular diameter of greater than 2 $\mu$m, with the long dimensions of the tabular grains primarily oriented parallel to the plane of the support, and the element is arranged with respect to the capacitor in a way such that the electromagnetic field lines generated by the capacitor are parallel to the plane of the support. The measurement of the photoelectron response is also preferably conducted at ambient temperature.

DETAILED DESCRIPTION OF THE INVENTION

Figure 1:
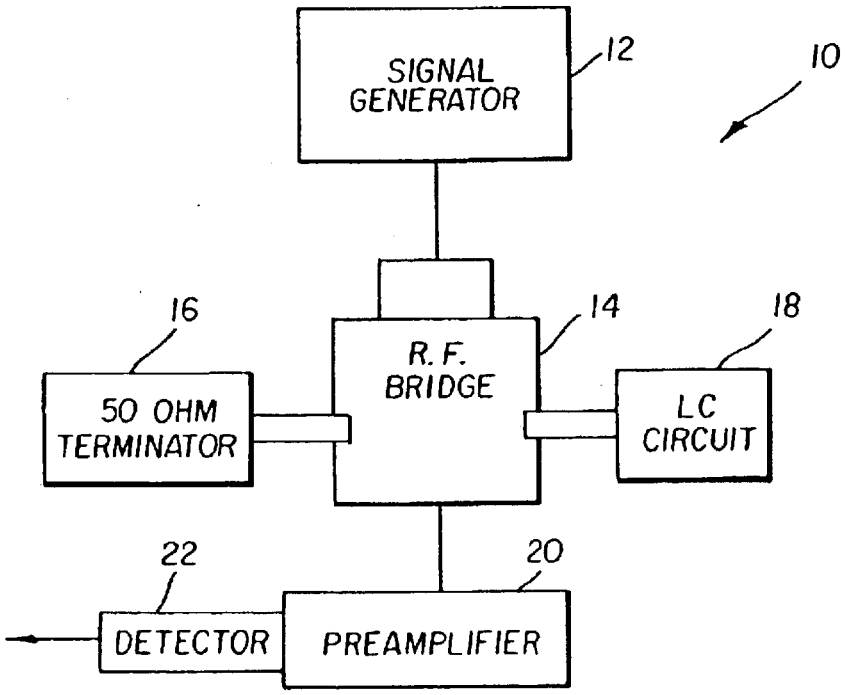
FIG. 1 (PRIOR ART)
FIG. 1 (prior art) is a schematic drawing of a radio frequency photoconductivity measurement apparatus which may be used in the electronic process of the present invention.

The present invention has the advantage of improving performance in imaging systems such as described in EP 1 139 168, the disclosure of which is incorporated by reference herein in its entirety, which eliminate the need for chemical processing of photographic film for development. In accordance with the present invention, an imaging element is employed which comprises photoconductor particles, e.g. silver halide grains, that have deep electron traps such that imagewise exposure results in an increase in photoconductivity of the photoconductor particles. In the examples presented here the photoconductivity of the imaging element is measured in the following way. An imagewise exposed element is placed in a measurement capacitor in a tuned radio frequency circuit. The change in the capacitance of this tuned circuit is then measured when the photoconductor particles in the imaging element are exposed and the free electrons are excited into the conduction band during the measurement step. The presence of deep electron traps decreases the absolute photoconductivity of the photoconductor particles when measured with radio frequency photoconductivity measurement apparatus such as described in EP 1 139 168, but when the element is imagewise exposed before the photoconductivity measurement some deep traps are filled with electrons, and the relative photoconductivity of the imagewise exposed particles thus increases. The higher the image exposure level the greater the concentration of filled traps and the higher the photoconductivity relative to lesser-exposed photoconductor particles. The number of deep traps incorporated per photoconductive particle determines the maximum number of photoelectrons per particle that can be detected.

An electron trap is called deep if it easily holds a captured electron. It is known that the introduction of deep electron traps in silver halide grain crystals can be arranged by doping the silver halide grains during grain formation with "deep electron-trapping agent" (DETA) dopants, typically in the form of certain metal ligand complexes. A deep electron trap can be energetically defined in the energy diagram if it fulfills the following two conditions: the LUMO (lowest unoccupied molecular orbital) of the incorporated molecular entity (related complex) should be situated at least 0.5 eV below the conduction band of the photoconductor particle, while the trapping lifetime should be longer than 0.2 s (R. S. Eachus, M. T. Olm in "Cryst. Latt. Def. and Amorph. Mat.", 1989(18), 297–313). The LUMO of the related complex thus has the ability to trap an electron from the conduction band (D. F. Shriver, P. W. Atkins, C. H. Langford in "Inorganic Chemistry"—Oxford Univ. Press (1990), Oxford-Melbourne-Tokyo).

Examples of deep electron-trapping dopants which have been disclosed for use in conventional photographic silver halide imaging elements and which may be used in the photoconductive material imaging elements employed in the present invention include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Pat. No. 5,360,712 are also specifically contemplated. $RhCl_6^{-3}$ doped silver halide grains are preferred photoconductor particles for use in the present invention.

The filling of the deep electron traps, as defined above, to detect image exposures in photoconductors using radio frequency photoconductivity techniques requires that the photocarriers detected in the photoconductivity measurements are electrons. For many photoconductors this is not a problem since photoelectrons are the dominate carriers, but for others this can be assured by spectrally sensitizing the photoconductor for the spectral region of interest with electron injecting dyes and filtering, if necessary, any radiation that might excite electrons across the photoconductor bandgap. While the described deep electron trapping conditions are discussed primarily herein with respect to silver halide photoconductors, the same deep electron trapping energy level considerations would apply to other possible photoconductors. Other photoconductors which can be spectrally sensitized, e.g., include CdS as demonstrated by R. C. Nelson, J. Photogr. Sci. 22, 56 (1974), and ZnO as demonstrated by S. Manba and H. Shiki, J. Phys. Chem. 69, 774 (1965). For color systems photoconductors with intrinsic absorption in the blue or UV would be most useful. Additional photoconductors of interest include PbO, $TiO_2$, ZnS and CuBr, plus any others that meet all the above criteria.

Deep electron trapping centers added to the photoconductor particles are intended to control the photoelectron lifetime, i.e. there should be minimal impurity levels (preferably none) of substances that compete with the deep electron traps. Other possible electron loss processes, i.e. recombination and, for silver halides, latent image formation, should also be minimized. To accomplish this hole trapping compounds can be added to the photoconductor particle surface for all photoconductors, and for silver halides, silver ion complexing agents can also be added to the surface to prevent the formation of latent image. It may be particularly desirable, e.g., to employ a silver ion complexing agent present in reactive association with the silver halide grains where silver halide is employed as the photoconductive particles in the process of the invention. Silver halide complexing agents which can be used in this invention include nitrogen acids such as benzotriazole, and the alkyl, halo and nitro substituents thereof; tetraazaindene compounds as described, for example, in U.S. Pat. Nos. 2,444,605; 2,933,388; 3,202, 512; UK Patent 1,338,567 and Research Disclosure, Vol. 134, June 1975, Item 13452 and Vol. 148, August 1976, Item 14851; and mercaptotetrazole compounds as described, for example, in U.S. Pat. Nos. 2,403,927; 3,266,897; 3,397,987; 3,708,303 and Research Disclosure, Vol. 116, December 1973, Item 11684. While silver complexing agents are typically used in conventional photographic silver halide emulsions (i.e., those which are chemically sensitized to facilitate latent image formation upon exposure) as antifoggants at relatively low concentrations (e.g., typically less than 0.5 mmole per mole of silver halide) so as not to totally block latent image formation in the silver halide grains upon imagewise exposures, relatively higher levels (e.g., preferably at least 0.5 mmol per mole of silver halide, more preferably at least 1 mmole per mole of silver halide) would be preferred in the practice of the present invention in order to more effectively minimize $Ag_n^0$ latent image formation during imagewise exposure.

While deep electron trapping dopants have been disclosed for use in conventional photographic silver halide emulsions (which are chemically sensitized to facilitate latent image formation upon exposure) at relatively low concentrations (e.g., typically less than 100 dopant ions per silver halide grain) in order to provide a function such as contrast increase, silver halide grains which may be employed as the photoconductor material particles in imaging elements employed in the process of the invention are distinguished from conventional photographic element silver halide emulsion grains in that they preferably are not chemically sensitized, as $Ag_n^0$ latent image formation during imagewise exposure is actually preferably minimized in imaging elements employed in the method of the present invention in order to avoid electron loss processes. For purposes of the present invention, reference to silver halide grains "which have not been chemically sensitized" is thus intended to refer to grains which are not intentionally optimally chemically sensitized in accordance with conventional photographic element practice so as to facilitate formation of latent image $Ag_n^0$ centers upon imagewise exposure which are capable of development with conventional silver halide photographic development processes. Further, where the photoconductor material is a silver halide, deep electron trapping dopants will typically be present at substantially higher levels in the imaging elements employed in the present invention than would be typically employed in a conventional photographic silver halide element (e.g., at least 500, more preferably greater than 1000, and most preferably greater than 3,000 and up to 100,000 dopant ions per silver halide grain) as the number of electron trapping centers incorporated in the photoconductor particles must be greater than the number of photoelectrons generated by the maximum exposure level intended to be detected by the particles. The level will be typically more than 100 times the normal levels of DETA that are used, e.g., as contrast enhancing agents in conventional photographic silver halide imaging elements.

In accordance with a preferred embodiment of the invention, the photoconductive material imaging element employed in the method of the invention includes a planar support, or film base, and a silver halide emulsion imaging layer comprising silver halide grains doped with a deep electron trapping agent dopant such as described above. Silver halide emulsions are usually prepared by precipitating silver halide in the form of discrete grains (microcrystals) in an aqueous medium, where an organic peptizer is incorporated in the aqueous medium to disperse the grains. The deep electron trapping agent dopant preferably may be added during the grain precipitation. Emulsion grains employed in the photoconductive imaging element processed in accordance with the invention can include coarse, medium or fine silver halide grains and can be prepared by a variety of techniques, e.g., single-jet, double-jet (including continuous removal techniques) accelerated flow rate and interrupted precipitation techniques. Such emulsion grains can vary in size from Lippmann sizes up to the largest practically useful sizes. The silver halide grains in general may comprise any photoconductive combination of chloride, bromide, and iodide ions, and may be in any grain shape, including tabular grains. A tabular grain is one which has two parallel major faces that are clearly larger than any other crystal face and which has an aspect ratio of at least 2. The term "aspect ratio" is the ratio of the equivalent circular diameter (ECD) of the grain divided by its thickness (the distance separating the major faces). Tabular grain emulsions are those in which tabular grains account for greater than 50 percent of total grain projected area.

In a particularly preferred embodiment the photoconductive material imaging element employed in the method of the invention comprises DETA doped tabular silver halide grains, preferably with an average grain size equivalent circular diameter of at least 2 $\mu$m (more preferably at least 3 $\mu$m, and most preferably at least 4 $\mu$m), with the long dimensions of the tabular grains primarily oriented parallel to the plane of the support, and the element is arranged with respect to the capacitor in a way such that the electromagnetic field lines generated by the capacitor are parallel to the plane of the support. For tabular grain emulsions, average maximum sizes typically range up to equivalent circular diameters (ECD's) of 10 $\mu$m. Tabular grain thicknesses typically range from about 0.03 $\mu$m to 0.3 $\mu$m. The advantages that tabular grains impart to light sensitive emulsions generally increases as the average aspect ratio or tabularity of the tabular grain emulsions increases. Both aspect ratio (ECD/t) and tabularity (ECD/$t^2$, where ECD and t are measured in $\mu$m) increase as average tabular grain thickness decreases. Therefore it is generally sought to minimize the thicknesses of the tabular grains to the extent possible for imaging element applications. Absent specific application prohibitions, it is generally preferred that the tabular grains having a thickness of less than 0.3 $\mu$m (preferably less than 0.2 $\mu$m and optionally less than 0.07 $\mu$m) and accounting for greater than 50 percent (preferably at least 70 percent and optimally at least 90 percent) of total grain projected area, exhibit an average aspect ratio of greater than 5 and most preferably greater than 8. Tabular grain average aspect ratios can range up to 100, 200 or higher, but are more typically in the range of from about 12 to 80. Tabularities of >25 are generally preferred. In a particularly preferred embodiment, the photoconductor material imaging element employed in the method of the invention comprises a $RhCl_6^{-3}$ doped, tabular AgBr emulsion with an average grain size greater than 4 $\mu$m as the photoconductor, and the measurement of the photoelectron response is conducted at ambient temperature.

Varied forms of hydrophilic colloids are known to be useful as silver halide grain peptizers. While the overwhelming majority of silver halide emulsions described in the art employ gelatino-peptizers, the use of starch peptizers and grain precipitation techniques such as described in U.S. Pat. Nos. 5,604,085, 5,620,840, 5,667,955, 5,691,131, 5,733,718, 6,391,534 and 6,395,465, the disclosures of which are incorporated by reference herein, are particularly useful for the preparation of preferred tabular grain emulsions for use in imaging elements employed in the method of the invention, as such peptizers and precipitation techniques have been found to enable the preparation of emulsions with high percentages of tabular grains with relatively large diameters. Large, relatively monodisperse AgBr emulsions which may be precipitated in starch in accordance with such teachings are particularly preferred, as the photoconductivity signals for the undoped versions of these emulsions may be significantly larger than those observed for the largest practical gelatin precipitated emulsions. Higher signals translate to more sensitivity and the use of higher doping levels to allow greater photographic latitude. Use of such starch precipitated emulsions is also preferred as it may be possible to significantly decrease the rate of formation of latent image centers, i.e. new electron traps, during exposure of such emulsions with the addition of less than a monolayer of a silver ion complexing agent, so that latent image formation does not interfere with the filling of the deep traps during exposure. For gelatin precipitated emulsions, it has been observed that the same level of silver ion complexing agent may have much less effect on electron trap formation during exposure.

In order to use radio frequency photoconductivity measurement techniques to scan an imagewise exposed element in accordance with the method of the present invention, it is necessary to provide a measurement capacitor that is sensitive enough to detect a small spot size for good image resolution, and would allow the imaging element to be scanned in two dimensions. The following characteristics are preferably employed to achieve these goals: 1) Where the imaging element comprises tabular grains doped with DETAs, the imaging element sample should be placed in the capacitor so the long dimension of the tabular grain is parallel to the (RF) field; 2) The capacitor gap should be very small, i.e. on the order of the image resolution required; and 3) The imaging element should pass through or over the electrodes to allow 2 dimensional imaging.

Figure 2:
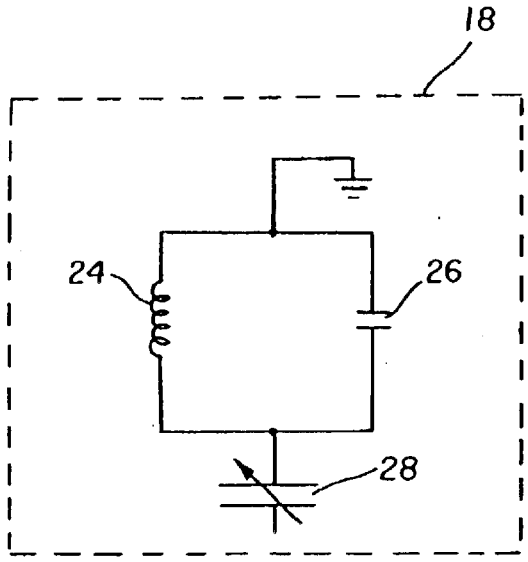
FIG. 2 (PRIOR ART)
FIG. 2 (prior art) is a detailed view of the tuned LC circuit of FIG. 1.
Figure 3:
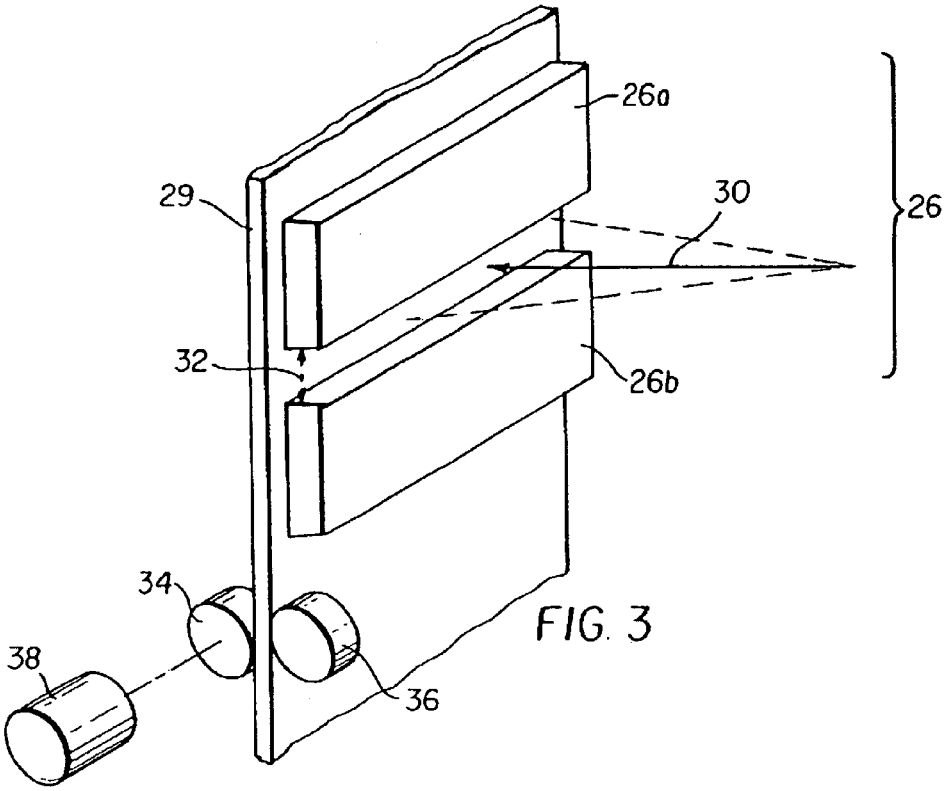
FIG. 3 is a detailed view of a capacitor electrode configuration in relation to an imaging element which may be used in the present invention.

Referring to FIG. 1, the method of the present invention may be carried out on radio frequency photoconductivity measurement apparatus 10, which as described in EP 1 139 168 includes a radio frequency signal generator 12 and a radio frequency bridge 14. In association with bridge 14 is a 50 ohm terminator 16 and a tuned LC circuit 18. A preamplifier 20 is provided as is detector 22. FIG. 2 illustrates, in greater detail, the tuned LC circuit 18 of FIG. 1 wherein is shown inductor 24 along with sample capacitor 26 and variable capacitor 28. FIG. 3 shows in detail the sample capacitor 26, which includes two plates 26*a* and 26*b* arranged coplanar with each other and adjacent an imaging element 29. A pulsed focused scanning light beam 30 is directed onto the imaging element 29 through a gap 32 formed by the capacitor plates 26*a* and 26*b*. The source of the scanning beam 30 may be provided, e.g., from a flash lamp with appropriate filters, or a light emitting diode or laser diode. An optical fiber, or an array of optical fibers, may be used to direct the scanning beam 30 to illuminate the imaging element 29 through the gap 32 of the sample capacitor 26. Preferably the gap is small, having a size on the order of the diameter of the scanning beam 30 (e.g. 20–100 $\mu$m). The gap may be filled with a microlens, or array of microlenses, to keep the gap clean and further focus the scanning beam spot size. The sample capacitor may preferably be constructed of two thin brass plates embedded in a low-rf-power-loss material, such as polytetrafluoroethylene or other electrical insulating material. A drive advance mechanism includes drive wheel 34 and idle wheel 36 and a motor 38 connected to drive wheel 34. After the light beam 30 scans the element 29, the advance mechanism incrementally advances the element 29 by one scan line, and the scan is repeated.

Figure 4:
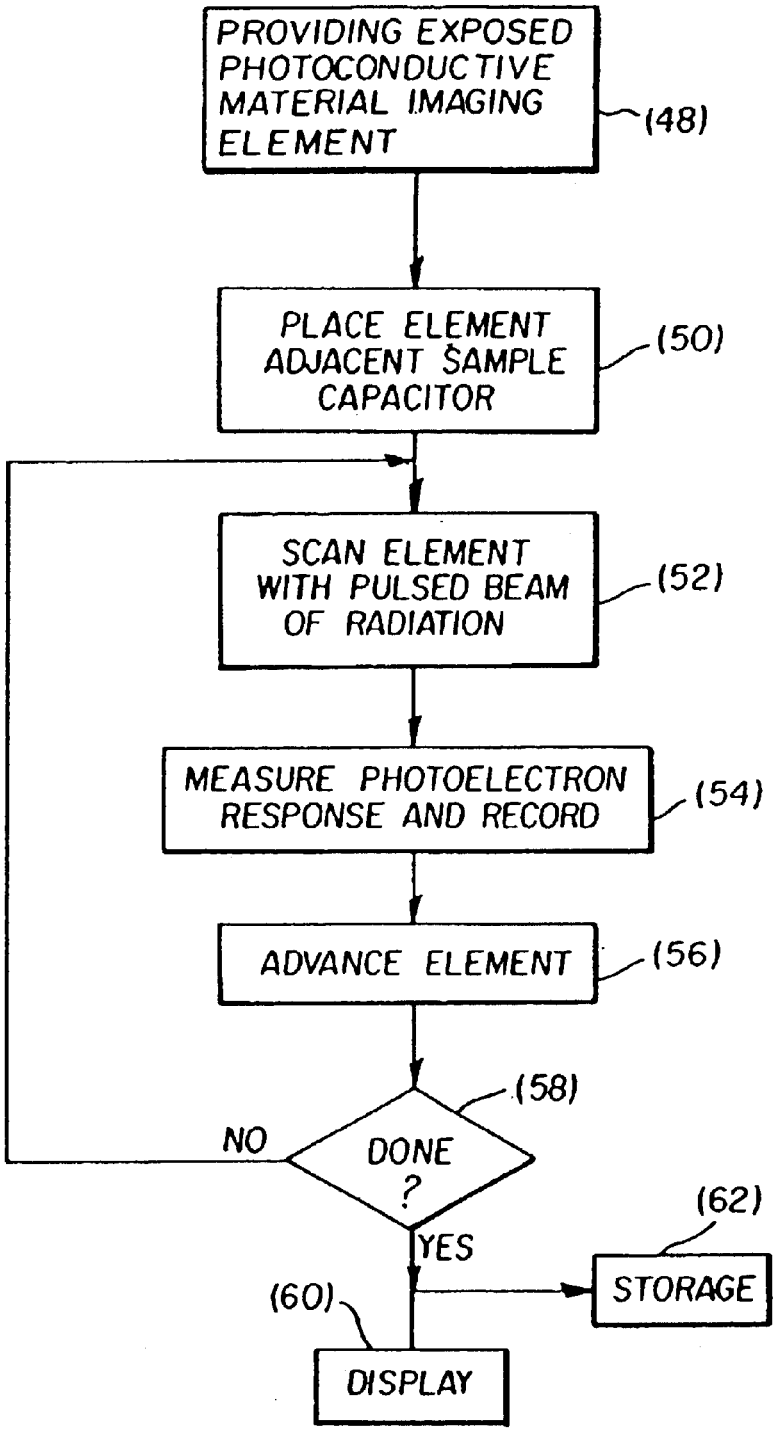
FIG. 4 is a flow diagram showing the individual steps in the electronic process of the present invention.

Referring to FIG. 4, the method of the present invention includes the steps of providing (48) an imagewise exposed photoconductive material imaging element comprising photoconductive particles which contain deep electron trapping agents which in an unfilled state effectively decrease the photoconductivity of the photoconductor particles, and wherein imagewise exposure of the photoconductive particles of the imaging element fill deep electron traps and increase the photoconductivity of exposed particles relative to unexposed particles; placing (50) the imagewise exposed element 29 adjacent to the sample capacitor 26; and scanning (52) the element 29 with the pulsed beam of light 30. The photoelectron response, wherein increased imagewise exposure in the photoconductive material results in an increased photoconductivity signal, is directly measured and recorded (54) by the radio frequency photoconductivity apparatus 10 and the element 29 is advanced (56) by one scan line. A check (58) is made to determine if the element has been completely scanned. If not, the next line is scanned (52) and the process is repeated until the element 29 has been completely scanned. After the element 29 has been scanned to read out the imagewise exposure information, the image signal can be displayed (60) or stored (62) for later viewing.

Figure 5:
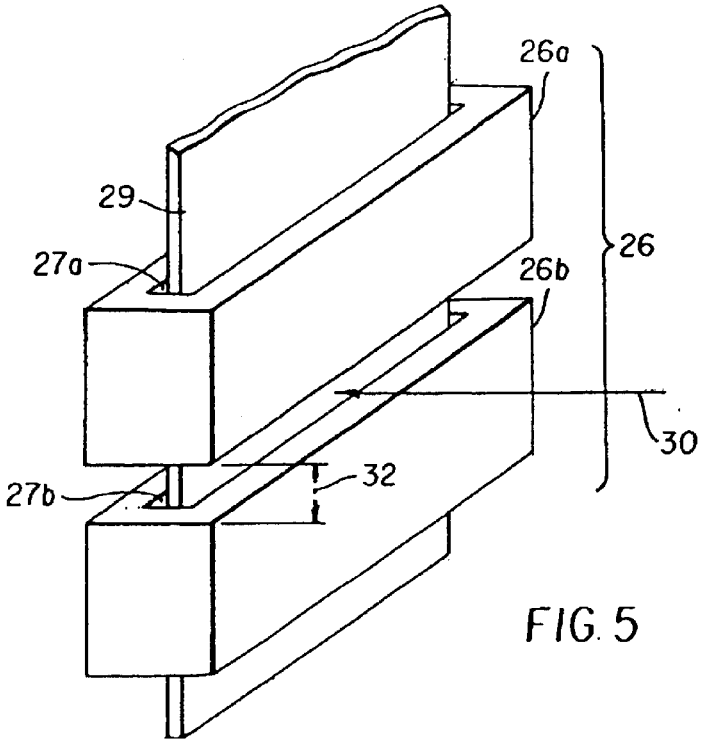
FIG. 5 is a detailed view of an alternative embodiment of an electrode configuration in relation to an imaging element which may be used in the present invention.

FIG. 5 shows in detail an alternative configuration which may be employed for sample capacitor 26 which includes two plates 26*a* and 26*b* with slots 27*a* and 27*b* through the center of each plate. These plates are arranged coplanar with each other. An imaging element 29 passes through slots 27*a* and 27*b* into the (RF) field established between the two plates. A pulsed focused scanning light beam 30 is directed onto element 29 through gap 32 formed by the capacitor plates 27*a* and 27*b*.

Figure 6:
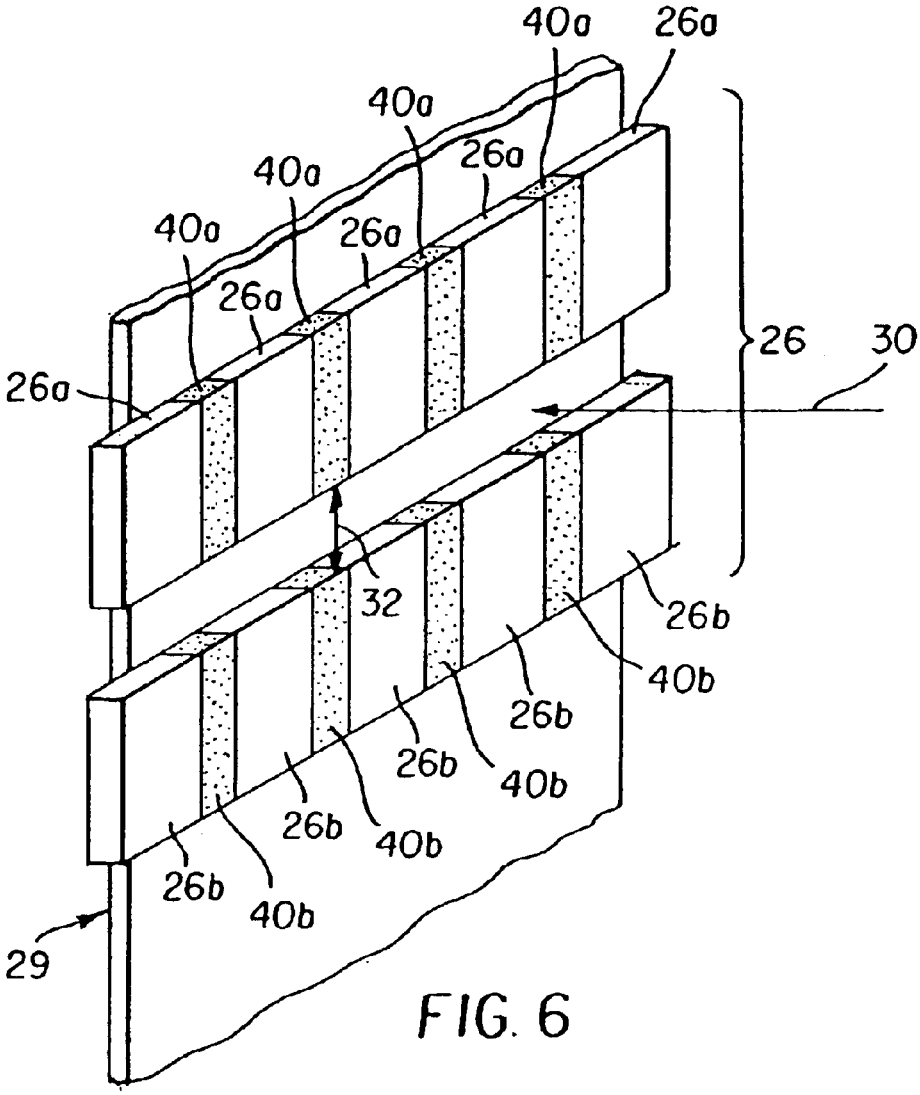
FIG. 6 is a schematic view of a further alternative embodiment of an electrode configuration in relation to an imaging element which may be used in the present invention, wherein the electrodes are segmented.

FIG. 6 shows in detail a possible capacitor array 26 which includes multiple (e.g. 5) plates 26*a* arranged coplanar with corresponding plates 26*b*. All of these plates are adjacent to an imaging element 29. These plates are separated by insulating regions 40*a* and 40*b*. A pulsed focused scanning light beam 30 is directed onto element 29 through the gap 32 between the plates. This arrangement increases the sensitivity of the apparatus by employing smaller capacitors. The drawback to this arrangement is that it has gaps between the capacitors where the imaging element cannot be scanned. In order to scan the entire width of the element 29, a second capacitor array and scanning beam shifted with respect to the first array can be provided, such that the locations of the capacitor plates in the second array occur in the gaps of the insulators in the first array. It will be understood that although each capacitor plate in FIG. 6 is shown with 5 elements, more or fewer than 5 may be used in the practice of the present invention.

Figure 7:
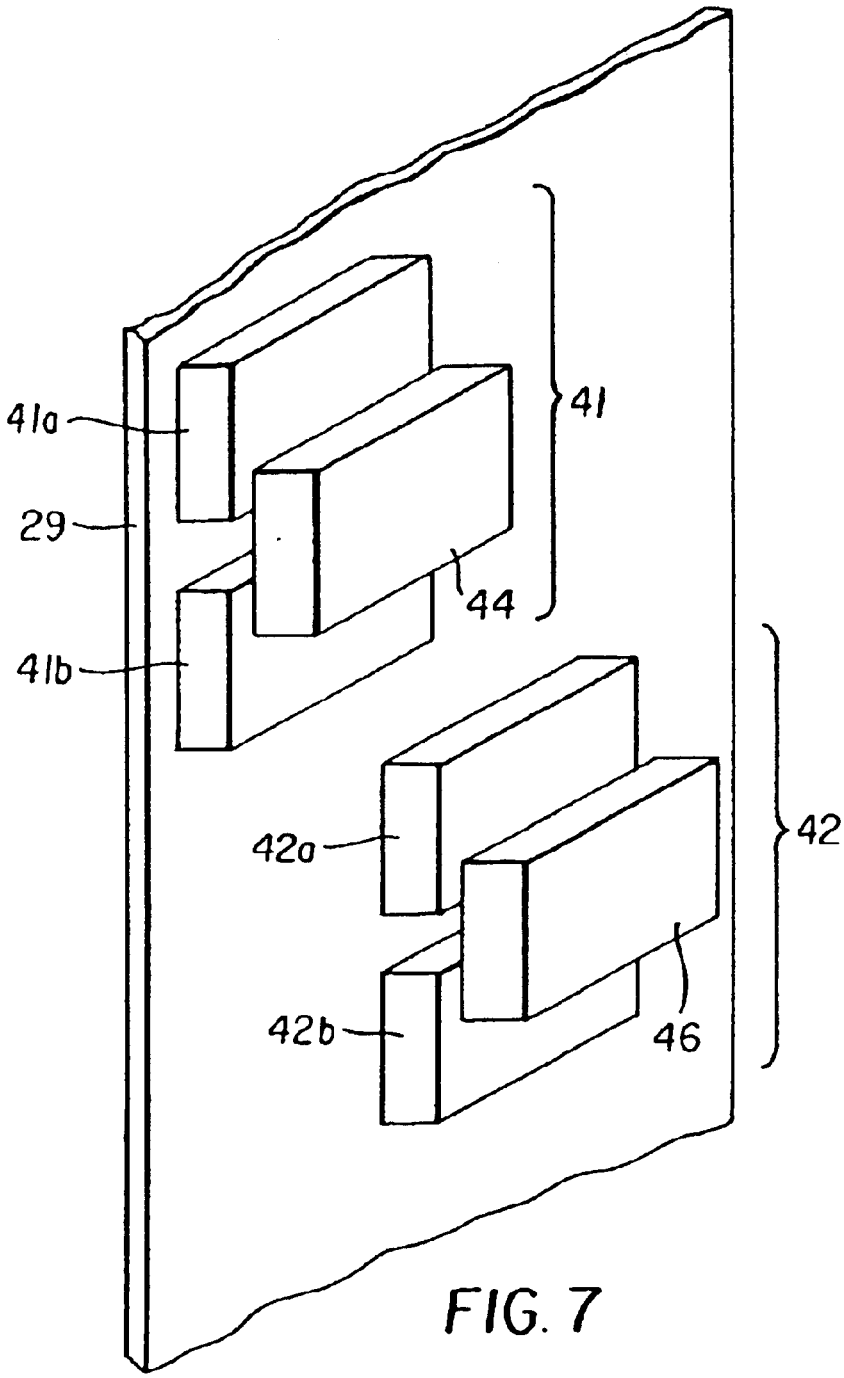
FIG. 7 is a schematic view of a still further alternative embodiment of an electrode configuration in relation to an imaging element which may be used in the present invention wherein segmented electrodes are provided with LED arrays for scanning the imaging element.

FIG. 7 shows an alternative capacitor array embodiment which may be employed in the present invention including capacitor 41 with coplanar plates 41*a* and 41*b* and capacitor 42 with coplanar plates 42*a* and 42*b*. Associated with these capacitors are LED arrays 44 and 46 respectively for scanning the imaging element through the gaps between the capacitor plates. Each capacitor and associated LED array scans a separate portion of the imaging element, and are shown staggered in the direction of imaging element travel so that they can be easily arranged to scan the entire width of the element. Although two such arrays are shown it should be understood that any number of such arrays can be employed across the width of the element.

The method of the invention is applicable to electronic processing of imaging elements intended to provide single or multi-color image recordings, through direct or indirect imagewise exposures. Examples of such elements include color film type imaging elements (e.g., direct exposure imaging elements) and x-ray film type imaging elements (e.g., indirect phosphor screen exposure imaging elements), including duplitized imaging elements with imaging layers coated on each side of an element support. Multicolor photoconductive material imaging elements which may be employed in the method of the invention may include multiple image recording layers sensitive to different light wavelengths.

Figure 8:
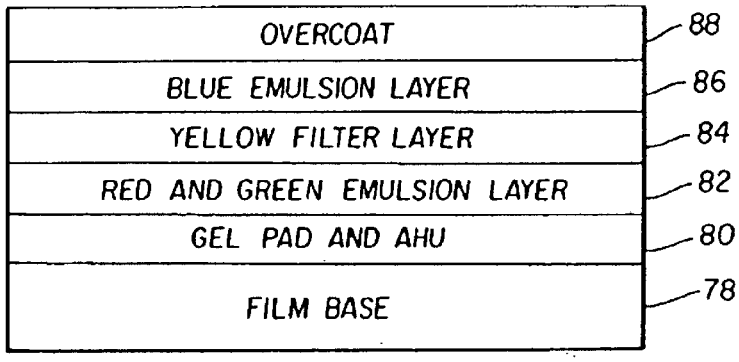
FIG. 8 is a schematic diagram of a film element particularly useful with the present invention.

FIG. 8 shows a schematic diagram for a simplified color imaging element useful with the present invention. This color element consists of a film base 78 coated with a gel pad and antihalation layer 80. An emulsion layer 82 is coated over the gel pad. Preferably this emulsion layer includes deep electron trapping agent doped tabular light sensitive silver halide grains. This emulsion layer contains both the green and the red sensitized emulsions in this particular embodiment. On top of the red and green sensitized emulsion layer is a yellow filter layer 84 to prevent blue radiation from reaching the red and green emulsion layer 82. A blue sensitized emulsion layer 86 (preferably also a deep electron trapping agent doped tabular grain emulsion) is coated on top of the filter layer 84 and a gelatin overcoat 88 is coated over the blue emulsion layer 86 for protection. Conventional red, green and blue photographic sensitizing dyes may be employed to spectrally sensitize the silver halide emulsions to a desired wavelength, and conventional antihalation, filter, and overcoat layers as typically employed in photographic elements may be employed to control light transmission to and to protect the various emulsion layers. The color information may be recovered from an exposed film element of this type by scanning the element separately with red, green and blue beams of light. Such simple imaging element film format eliminates the need for many of the dispersions (e.g., color-image-forming addenda such as color couplers, DIR couplers, etc, are not needed) or imaging element interlayers employed in conventional photographic imaging elements, thereby simplifying and reducing the cost of the imaging element manufacturing process. Only one spectrally sensitized emulsion per color is required since the resulting signal from individual photoconductor material particles (e.g., silver halide grains) is proportional to the exposure level of the particle. Further, as the imaging element is intended for electronic processing rather than conventional photographic development processing, the element layers may be designed to lock out oxygen and moisture as such materials no longer need to provide chemical permeability for wet processing solutions, which can provide improved keeping performance for such imaging elements.

In addition to eliminating the need for chemical processing and making it possible to coat, e.g., only 5 layers rather than the typical 14 used to prepare a conventional color photographic element film (and thus decreasing the environmental and manufacturing cost), further advantages include: 1) the silver halide grains would not require chemical sensitization, only spectral sensitization and addenda are required thus decreasing the cost and time of emulsion preparation and making it easier to optimize addenda for keeping; 2) increased sensitivity, as only one electron/trap would be required to change the photoconductivity compared to 3–4 typically required to form a latent image center; and 3) measurements are easier, as it is easier to measure a small increase in photoconductivity on a small signal than a small decrease in photoconductivity on a large signal.

Figure 9:
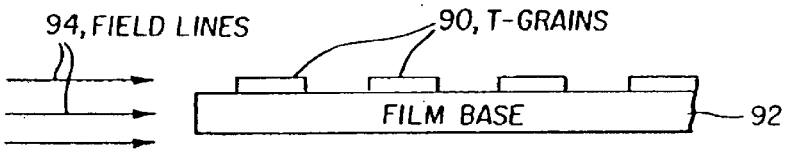
FIG. 9 is a schematic diagram useful in describing the orientation of deep electron trapping agent doped tabular grains with respect to the electric field produced by sample capacitor according to a preferred mode of practicing the present invention.

FIG. 9 illustrates the orientation of deep electron trapping agent doped tabular silver halide grains 90 and the film base 92 with respect to the electric field 94 in the preferred embodiment of the film element. For other emulsion types and photoconductor material particles other field orientations may be useful.

EXAMPLES

Preparation of Deep Electron Trapping Agent Doped Silver Halide Emulsion E-1

A starch solution was prepared by heating at 80° C. for 30 minutes a stirred mixture of 8 L distilled water and 160 g of an oxidized cationic waxy corn starch (STA-LOK 140 obtained from A. E. Staley Manufacturing Co., Decatur, Ill., 100% amylopectin that had been treated to contain quaternary ammonium groups and oxidized with 2 wt % chlorine bleach, containing 0.31 wt % nitrogen and 0.00 wt % phosphorous). After cooling to 40° C., the weight was adjusted to 8.0 kg with distilled water, 27 mL of a 2M NaBr solution was added, and the pH was adjusted to 3.0 with nitric acid.

To a vigorously stirred reaction vessel of the starch solution at 40° C. and maintained at pH 3.0 throughout the emulsion precipitation, a 2.0 M $AgNO_3$ solution was added at 200 mL per minute for 12 seconds. Concurrently, a salt solution of 2.0 M NaBr was added at 200 mL per minute. After a 30 second hold, the NaBr solution was added at 200 mL per minute until the pBr reached 1.44. After a 30 second hold, the temperature was increased to 75° C. in 21 minutes and then held for 10 minutes. The $AgNO_3$ solution was then added at 10 mL per minute for 1 minute followed by an accelerated rate of addition to 54 mL per minute during 60 minutes and held at this rate. A solution of 2.0 M NaBr, to which had been recently added $2.6\times10^{-7}$ M/L of sodium hexachlororhodate (III) dodecahydrate, was concurrently added at a rate needed to maintain the pBr at 1.44. When a total of 2.0 moles of silver had been added, the addition of the NaBr solution was stopped and the $AgNO_3$ solution was added at 4 mL per minute until the pBr reached 2.41. The addition was stopped and 38 mL of a 8.5 mmolar solution of potassium hexacyanoruthenate (II) was added. The addition of the $AgNO_3$ solution was resumed at a constant flow rate of 25 mL per minute until a total of 6 moles of silver had been added. The NaBr solution containing the rhodium salt was concurrently added to maintain a constant pBr of 2.41. The total making time of the emulsion was approximately 87 minutes.

The resulting tabular grain emulsion was washed by ultrafiltration at 30° C. to a pBr of 2.8. Then 750 g of a 20% bone gelatin solution adjusted to pH 3.0 (methionine content approx. 55 micromole per g of gelatin) was rapidly added with good stirring. The {111} silver bromide tabular grains had an average equivalent circular diameter of 7.8 μm, an average thickness of 0.12 μm, and an average aspect ratio of 65. The tabular grain population made up 98% of the total projected area of the emulsion grains.

The metal dopant levels were measured by atomic absorption spectroscopy at 25 molar ppm $Ru(CN)_6^{-3}$ ($2.5\times10^{-5}$ mole/mole Ag) and 70 molar ppb $Rh(Cl)_6^{-3}$ ($7.0\times10^{-8}$ mole/mole Ag). The average number of rhodium ions (deep electron trapping agent) per tabular silver halide grain was approximately 8,000.

Preparation of Comparison Emulsion CE-1

A comparison emulsion was prepared similarly to emulsion E-1 above, except a 2.0 M NaBr solution without rhodium dopant was used instead of the sodium bromide solution containing sodium hexachlororhodate (III) dodecahydrate. The resulting {111} tabular grains had an average equivalent circular diameter of 6.9 μm, an average thickness of 0.105 μm, and an average aspect ratio of 66. The tabular grain population made up 99% of the total projected area of the emulsion grains.

Preparation of Imaging Element Comprising Deep Electron Trapping Agent Doped Silver Halide Emulsion E-1, and Comparison Element Comprising Emulsion CE-1

Deep electron trapping agent doped silver halide emulsion E-1 was spectrally sensitized with a combination of blue sensitizing dyes SD-1 and SD-2 (each at 0.35 mmol/Ag mol) and coated with 1 mmol/Ag mol of 4-hydroxy-6-methyl-1,3,3a,7-tetraazaindene (TAI) and 0.1 mmol/Ag mol of N-allyl-benzothiazolium. Comparison emulsion CE-1, prepared without the $Rh(Cl)_6^{-3}$ dopant, was spectrally sensitized with the same combination of blue sensitizing dyes and was also conventionally optimally chemically sensitized with 1 μmol/Ag mol of a reduction sensitizer and 0.2 μmol/Ag mol of a sulfur sensitizer. 0.2 mmol/Ag mol of 4-hydroxy-6-methyl-1,3,3a,7-tetraazaindene was added as an addendum. These melts were then coated at a silver coverage of 5.2 g Ag/m$^2$ over a film support previously coated with an antihalation (AHU) layer.

SD-1

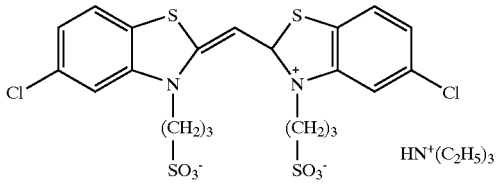

SD-2

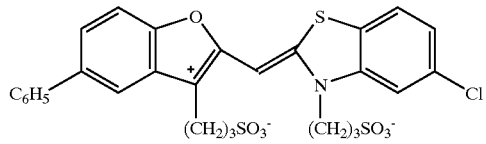

Exposure and Electronic Processing of Imaging Elements

Six 35 mm×300 mm coatings of each emulsion were prepared for measurement in the radio frequency photoconductivity measurement apparatus according to FIG. 1. For exposure each sample was mounted on a holder identical to the film holder on the photoconductivity apparatus. The holder had a single 5 mm exposure step positioned to coincide with the position of the sample capacitor in the equipment. Each of the six samples was given a different exposure with a EG&G sensitometer by adjusting the neutral density filters along with a Wratten 47a (blue filter) in the EG&G exposure plane. For each sample, then, it was possible to move the photoconductivity sample holder in 200 μm steps and first scan an unexposed part of the strip and then make at least 10 readings on the exposed region of the strip. The radio frequency photoconductivity measurement exposure was a flash lamp exposure that was filtered with a Wratten 47a blue filter and which was focused into a 30 μm optical fiber. The other end of the optical fiber was placed in a holder in close proximity to the gap in the sample capacitor. Table 1 below records the exposure, the increase in photoconductivity signal observed for the $RhCl_6^{-3}$ deep electron trapping agent doped emulsion which was not chemically sensitized, and the decrease in signal for the comparison chemically sensitized emulsion without deep electron trapping agent dopant.

TABLE 1

| $10^{-2}$s EG&G Exposure + | Delta Photoconductivity Signal (mV) | |
|---|---|---|
| Wratten 47A blue filter | DETA-Doped Emulsion E-1 | Emulsion CE-1 (without DETA dopant) |
| +1.8 ND | +46 ± 1 | −17 ± 1 |
| +2.1 ND | +34 ± 1 | −10 ± 1 |
| +2.4 ND | +21 ± 1 | −4.5 ± 1 |
| +2.7 ND | +13 ± 1 | |
| +3.0 ND | +8 ± 1 | |
| +3.3 ND | +4.5 ± 1 | |

Figure 10:
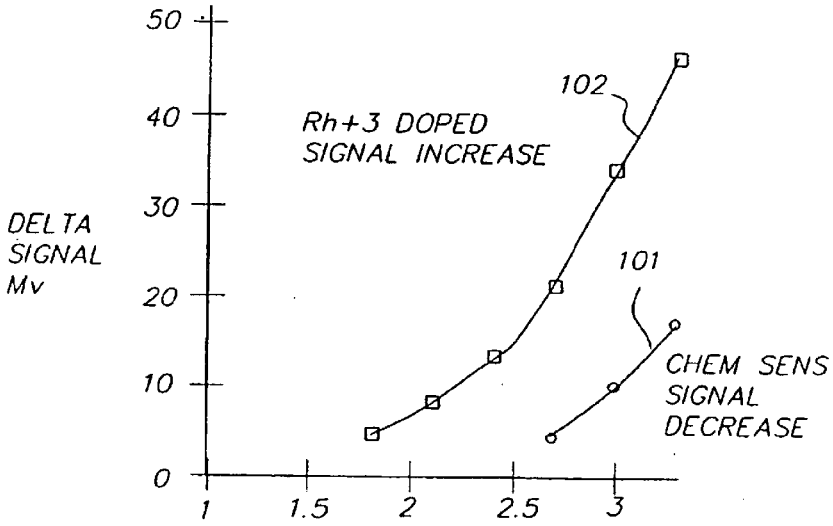
FIG. 10 illustrates signal change (in mV) vs. exposure curve obtained by electronic processing of identically exposed imaging elements for invention and comparison examples.

FIG. 10 shows a plot of the data in Table 1. Note, the photoconductivity response curve 101 of the comparison chemically sensitized emulsion denotes the magnitude of the decrease in signal (in mV) with increasing imagewise exposure, while photoconductivity response curve 102 of the deep electron trapping agent doped imaging element denotes the increase in signal with increasing imagewise exposure in accordance with the method of the present invention.

The invention has been described in detail with particular reference to certain preferred embodiments thereof, but it will be understood that variations and modifications can be effected within the spirit and scope of the invention.

What is claimed is:

1. A method of electronic processing of an imagewise exposed photoconductive material imaging element employing pulsed radiation and radio frequency photoconductivity apparatus having a sample capacitor with a gap, comprising the steps of:

a) placing the imagewise exposed photoconductive material imaging element in an electromagnetic field adjacent the sample capacitor;

b) scanning the element through the gap in the sample capacitor with a pulsed, focused beam of radiation;

c) directly measuring the photoelectron response of the element and recording the resulting signals from the radio frequency photoconductivity apparatus; and d) advancing the element past the capacitor and repeating steps b) and c);

wherein the photoconductive material imaging element comprises photoconductive particles which contain deep electron trapping agents which in an unfilled state effectively decrease the photoconductivity of the photoconductor particles, and wherein imagewise exposure of the photoconductive particles of the element fill deep electron traps and increase the photoconductivity of exposed particles relative to unexposed particles, such that increased imagewise exposure in the photoconductive material results in an increased photoconductivity signal obtained in step c).

2. The method claimed in claim 1, wherein the photoconductive material imaging element includes a planar support and a silver halide emulsion imaging layer comprising silver halide grains which have not been chemically sensitized to optimize formation of latent image $Ag_n^0$ centers upon imagewise exposure and which are doped with a deep electron trapping agent dopant.

3. The method of claim 2, wherein the silver halide grains comprise tabular grains with the long dimensions of the tabular grains primarily oriented parallel to the plane of the support, and the element is arranged with respect to the capacitor in a way such that the electromagnetic field lines generated by the capacitor are parallel to the plane of the support.

4. The method of claim 3, wherein the average grain size equivalent circular diameter of the tabular grains is at least 2 $\mu$m.

5. The method of claim 3, wherein the average grain size equivalent circular diameter of the tabular grains is at least 3 $\mu$m.

6. The method of claim 3, wherein the average grain size equivalent circular diameter of the tabular grains is at least 4 $\mu$m.

7. The method of claim 3, wherein the capacitor comprises plates provided with a slot through which the imaging element is located.

8. The method of claim 7, wherein the capacitor plates are coplanar.

9. The method of claim 2, wherein the silver halide grains of the imaging layer are doped with a $K_3RhCl_6$, $(NH_4)_2Rh(Cl_5)H_2O$, $K_2RuCl_6$, $K_2Ru(NO)Br_5$, $K_2Ru(NS)Br_5$, $K_2OsCl_6$, $Cs_2Os(NO)Cl_5$, or $K_2Os(NS)Cl_5$ deep electron trapping agent dopant.

10. The method of claim 2, wherein the silver halide grains of the imaging layer are doped with $RhCl_6^{-3}$ complex.

11. The method of claim 2, wherein the photoconductive material element comprises a plurality of layers of photoconductive material sensitive to a plurality of wavelengths of light, and wherein the step of scanning the element includes separately scanning the element with corresponding wavelengths of light.

12. The method of claim 11, wherein the photoconductive material element is sensitive to red, green, and blue wavelengths of light, and the element includes a film base, a red and green sensitive emulsion layer over the film base, a yellow filter layer over the red and green sensitive emulsion layer, and a blue sensitive emulsion layer over the yellow filter layer.

13. The method of claim 2, wherein the photoconductive material element further comprises a silver ion complexing agent present in reactive association with the silver halide grains at a concentration of at least 0.5 mmol per mole of silver halide for minimizing $Ag_n^0$ latent image formation during imagewise exposure.

14. The method of claim 2, wherein the photoelectron response is measured at ambient temperature.

15. The method of claim 1, wherein the capacitor comprises plates provided with a slot through which the imaging element is located.

16. The method of claim 15, wherein the capacitor plates are coplanar.

17. The method of claim 1, wherein the photoconductive material element comprises a plurality of layers of photoconductive material sensitive to a plurality of wavelengths of light, and wherein the step of scanning the element includes separately scanning the element with corresponding wavelengths of light.

18. The method of claim 1, wherein the photoelectron response is measured at ambient temperature.

* * * * *